US007507932B2

(12) United States Patent
Hunger et al.

(10) Patent No.: US 7,507,932 B2
(45) Date of Patent: Mar. 24, 2009

(54) HEAVY-DUTY CIRCUIT BREAKER WITH MOVEMENT REVERSAL

(75) Inventors: Olaf Hunger, Schaffhausen (CH); Max Claessens, Gebenstorf (CH); Martin Holstein, Baden-Rütihof (CH); Johan Abrahamsson, Wettingen (CH); Martin Kriegel, Unterehrendingen (CH)

(73) Assignee: ABB Technology AG, Zurich (CH)

( * ) Notice: Subject to any disclaimer, the term of this patent is extended or adjusted under 35 U.S.C. 154(b) by 57 days.

(21) Appl. No.: 11/709,232

(22) Filed: Feb. 22, 2007

(65) Prior Publication Data

US 2007/0181536 A1 Aug. 9, 2007

Related U.S. Application Data

(63) Continuation of application No. PCT/CH2005/000431, filed on Jul. 22, 2005.

(30) Foreign Application Priority Data

Aug. 23, 2004 (EP) ..... 04405525

(51) Int. Cl.
*H01H 33/70* (2006.01)

(52) U.S. Cl. ..... 218/78; 218/154; 218/84

(58) Field of Classification Search ..... 218/43, 218/45, 46, 51, 53, 54, 57, 59, 60–64, 67, 218/72, 73, 78, 84, 153, 154
See application file for complete search history.

(56) References Cited

U.S. PATENT DOCUMENTS 5,293,014 A * 3/1994 Perret ..... 218/57
5,902,978 A * 5/1999 Zehnder et al. ..... 218/57
6,013,888 A * 1/2000 Thuries ..... 218/14
6,342,685 B1 * 1/2002 Perret ..... 218/78
6,429,394 B2 * 8/2002 Hunger et al. ..... 218/155

(Continued)

FOREIGN PATENT DOCUMENTS

DE 100 03 357 C1 7/2001

(Continued)

OTHER PUBLICATIONS

International Search Report.

*Primary Examiner*—Elvin G Enad
*Assistant Examiner*—Marina Fishman
(74) *Attorney, Agent, or Firm*—Buchanan Ingersoll & Rooney PC

(57) ABSTRACT

The heavy-duty circuit breaker contains a first moveable arcing contact piece and a second moveable arcing contact piece as well as an auxiliary drive for driving the second arcing contact piece. An arc may burn between the arcing contact pieces. The heavy-duty circuit breaker has a heating chamber for temporarily storing quenching gas heated by the arc and a throat for guiding a quenching gas flow, which throat is connected to the heating chamber by a channel. The throat can be blocked by one of the two arcing contact pieces, which is the blocking contact piece. The auxiliary drive is designed such that, during an opening operation, a movement direction reversal of the second arcing contact piece from a movement in opposite directions to a movement in the same direction of the two arcing contact pieces takes place, if the throat is no longer blocked by the blocking contact piece.

23 Claims, 3 Drawing Sheets

U.S. PATENT DOCUMENTS 6,483,064 B2 11/2002 Dufournet et al.
6,489,581 B2 * 12/2002 Ozil et al. ..... 218/61

FOREIGN PATENT DOCUMENTS

DE 100 03 359 C1 7/2001
EP 0 313 813 5/1989
EP 0 741 399 A1 11/1996
WO WO 00/52721 A1 9/2000

* cited by examiner

HEAVY-DUTY CIRCUIT BREAKER WITH MOVEMENT REVERSAL

RELATED APPLICATIONS

This application claims priority under 35 U.S.C. §119 to EP Application 04405525.9 filed in European Patent Office on 23 Aug. 2004, and as a continuation application under 35 U.S.C. §120 to PCT/CH2005/000431 filed as an International Application on 22 Jul. 2005 designating the U.S., the entire contents of which are hereby incorporated by reference in their entireties.

FIELD

The disclosure relates to a heavy-duty circuit breaker and to a method for opening a heavy-duty circuit breaker.

BACKGROUND INFORMATION

Such a heavy-duty circuit breaker and such a method are known, for example, from the document DE 100 03 359 C1. This describes a heavy-duty circuit breaker having two moveable arcing contact pieces and a heating chamber for temporarily storing quenching gas, which has been heated by an arc which may burn between the arcing contact pieces. The breaker has an insulating nozzle, which has a throat for guiding a quenching gas flow, which throat in turn is connected to the heating chamber by means of a channel. At first, the two contact pieces move in opposite directions, wherein the contact separation takes place and the throat is at least partially blocked by the second of the two contact pieces. While the throat is still at least partially closed by the second contact piece, a reversal of the movement direction of the second contact piece takes place. The second contact piece therefore moves in the same direction as the first of the two contact pieces. As a result of the fact that the throat is still at least partially blocked by the second contact piece during the movement direction reversal, an increase in the quenching gas pressure in the heating chamber can be produced. Thus, more powerful arc blowing can be achieved.

SUMMARY

The disclosure can enable producing effective arc blowing, wherein a large quantity of quenching gas can be produced within a very short time period for a defined quenching gas flow to be realized.

An exemplary embodiment of a heavy-duty circuit breaker can advantageously be filled with a quenching gas and contains a first moveable arcing contact piece and a second moveable arcing contact piece as well as a drive for driving the first arcing contact piece and an auxiliary drive for driving the second arcing contact piece. An arc may burn between the arcing contact pieces. The heavy-duty circuit breaker has a heating chamber for temporarily storing quenching gas heated by the arc and an insulating nozzle, which has a throat for guiding a quenching gas flow, which throat is connected via a channel to the heating chamber. The throat can be blocked at least partially by one of the two arcing contact pieces, which is referred to as the blocking contact piece. The auxiliary drive can be such that, during an opening operation, a movement direction reversal of the second arcing contact piece from a movement in opposite direction to a movement in the same direction of the two arcing contact pieces takes place.

The exemplary embodiment of a heavy-duty circuit breaker is characterized in that the auxiliary drive can be such that, during an opening operation, the movement direction reversal of the second arcing contact piece takes place if the throat is no longer at least partially blocked by the blocking contact piece.

This makes it possible to vaporize, owing to the arc, material from the insulating nozzle along the entire length of the throat during a substantial part of the arcing time (arc-burning period). A large surface, in particular the entire inner surface of the throat, can therefore be used for producing (vaporizing) arc-quenching material over a relatively long period of time. As a result, a large quantity of arc-quenching material is produced, so that efficient arc blowing can be achieved.

The movement direction reversal which takes place once the throat has been released by the blocking contact piece allows to optimize the quenching gas flow close to the blocking contact piece. The distance between the two contact pieces, depending on the ratio of the speeds of the two contact pieces, can (slightly) be increased or can be decreased or, particularly advantageously, can be kept essentially constant. In particular, a distance between the blocking contact piece and the throat can also (slightly) be increased or can be decreased or, particularly advantageously, can be kept essentially constant. If, for example, the movement of the insulating nozzle is coupled in a ratio of 1:1 (rigidly) to the movement of the first contact piece and therefore the movement in the same direction (after the movement direction reversal) of the two contact pieces is likewise essentially equal, a predeterminable distance between the throat and the blocking contact piece can be kept essentially constant.

Owing to the movement reversal, an initially antiparallel movement or movement in opposite directions of the two arcing contact pieces therefore becomes a parallel movement or movement in the same direction of the two arcing contact pieces.

In particular, if a gear, which is driven by the drive, is used as the auxiliary drive, in the case of the selection of a speed ratio $v1/v2$ of the speed $v1$ of the first arcing contact piece to the speed $v2$ of the second arcing contact piece of $v1/v2 \approx 1:1$ given a movement of the contact pieces in the same direction, a constant distance between the contact pieces (and possibly also a constant distance between the throat and the blocking contact piece) can be achieved, which even remains constant when the breaker movement is braked by a damping mechanism. It is thus also possible to essentially eliminate the influence of return movement on the mentioned distances. Return movement arises, if the movement of a driven contact piece is impeded by quenching gas in the heating chamber, with the result that a movement direction reversal of at least one of the contact pieces occurs.

It is therefore possible in the exemplary embodiment of a heavy-duty circuit breaker to achieve effective control of the distances between the contact pieces and of the throat/contact piece distance such that desired flow conditions, in particular close to the blocking contact piece, can be set and maintained even in different switching cases. Optimization of the quenching gas flow in the vicinity of the contact pieces is made possible.

The arcing contact pieces can at the same time also be rated current contact pieces. Advantageously, however, separate rated current contact pieces can also be provided in addition to the arcing contact pieces. In an opening operation, first the rated current contact pieces can be separated from one another so that the electrical current to be interrupted commutates to the arcing contact pieces. Then, the arcing contact pieces can be separated, with an arc being struck.

The movement direction reversal of the second arcing contact piece from an opposite movement to a concurrent movement of the two arcing contact pieces, when the throat is no longer at least partially blocked by the blocking contact piece, does not exclude a further movement direction reversal of the second arcing contact piece from a movement in opposite directions to a movement in the same direction of the two arcing contact pieces, which movement direction reversal typically occurs beforehand and may take place while the throat is still at least partially blocked by the blocking contact piece.

The throat can also be referred to as the nozzle channel.

The auxiliary drive may contain an electro-dynamic drive. In addition to the electrodynamic drive, the auxiliary drive may also contain a transmission or gear.

Advantageously, the auxiliary drive may be a gear, which can be driven by the drive, in particular a gear which contains a slotted-link disk. Advantageously, the gear may have a lever and in addition also an angled lever.

In particular, the gear may have the following properties: a bolt, which can be mounted in rotatable fashion at a first end of a lever, is provided on the blocking contact piece. A bolt is mounted in rotatable fashion at the second end of the lever and is mounted in rotatable fashion on a first limb of an angled lever. A bolt, which can be mounted in rotatable fashion, is provided at the second end of the angled lever and engages with a slotted-link disk. The angled lever is in addition connected in rotatable fashion to a nonmoving part of the heavy-duty circuit breaker. Advantageously, the axes of rotation of the mentioned rotations can be aligned parallel to one another. The slotted-link disk is connected, in particular rigidly connected, to the output side. Advantageously, the gear has a dual design, the two embodiments advantageously being arranged mirror-symmetrically with respect to a plane, which is aligned parallel to an axis of the blocking contact piece.

A gear can also have at least two levers, the ends of which have slots, which come into engagement, one after the other, with a transmission rod in the case of an opening operation. Details on the structural design of such a gear can be learned from the mentioned document DE 100 03 359 C1, the entire disclosure content of which has hereby been incorporated in the description.

In one exemplary embodiment, the second arcing contact piece can be the blocking contact piece.

In one further exemplary embodiment, an auxiliary nozzle, which together with the insulating nozzle forms the channel, can be arranged adjacent to the first arcing contact piece.

In one further exemplary embodiment, the insulating nozzle can be driven by means of the drive. In particular, the movement of the insulating nozzle can be coupled directly and rigidly or else by means of a gear to the movement of the first contact piece. In case of rigid coupling, a constant geometry of the channel may be present.

In one further exemplary embodiment, the throat can be essentially cylindrical, and, advantageously, the blocking contact piece can likewise be essentially cylindrical. The diameter of the respective cylinder (of the throat or of the second contact piece) does not need to be completely constant and can vary slightly. Deviations from a circular cross section to, for example, elliptical cross sections can be possible.

The heavy-duty circuit breaker may be in the form of a self-blowing or self-extinguishing circuit breaker. In this case, the volume of the heating chamber is constant. The heavy-duty circuit breaker may also be in the form of a puffer circuit breaker. In this case, the heating chamber is also a compression chamber, whose volume is reduced during an opening operation in order to achieve improved arc blowing owing to the additional pressure. An exemplary embodiment of a heavy-duty circuit breaker can also have a heating chamber, with a constant volume, and in addition a compression chamber, the volume at least of the compression chamber being reduced during an opening operation. Advantageously, a valve can then be provided between the compression chamber and the heating chamber.

Advantageously, the auxiliary drive can be designed such that, in a first phase, during which the movement in opposite directions of the arcing contact pieces takes place, a ratio $v1/v2$ of the speed $v1$ of the first arcing contact piece to the speed $v2$ of the second arcing contact piece of $v1/v2 \leqq 1:2.4$, in particular of $v1/v2 \leqq 1:2.8$, can be achieved. Such large speed ratios make it possible to achieve a large distance between the two arcing contact pieces within a very short period of time. If, for example, the drive and the first arcing contact piece have a speed of 5 m/s, at a speed ratio of $v1/v2=1:3$ a relative speed $v12$ of 20 m/s is reached. In this way, very rapid contact separation can be achieved (high speed of the arcing contact pieces during or shortly after the contact separation). Relative speeds of $v12 \geqq 13$ m/s, $v12 \geqq 15$ m/s or of $v12 \geqq 19$ m/s can also be suitable for this purpose. If the throat has a long length (large axial extent), a very large surface of the insulating nozzle can thus be subjected to the arc, which allows to vaporize large quantities of material from the insulating nozzle, with the result that efficient arc blowing can be achieved. In particular, throat lengths of more than 40 mm, advantageously more than 50 mm and more than 60 mm, can be used.

Advantageously, the auxiliary drive can be designed such that, in a second phase, which takes place during the movement in the same direction of the arcing contact pieces, $0.5 \leqq v1/v2 \leqq 1.2$, in particular $0.75 \leqq v1/v2 \leqq 1.15$, applies for the ratio $v1/v2$ of the speed $v1$ of the first arcing contact piece to the speed $v2$ of the second arcing contact piece. Particularly advantageously, the speed ratio $v1/v2$ is between 0.9 and 1.1 or close to one or is essentially one. In this manner, well defined flow conditions can be achieved close to the blocking contact piece. In particular, the distance between the two arcing contact pieces from each other and the distance between the blocking contact piece and the throat can be kept essentially constant even if the drive is damped at the end of the opening operation or if there is a return movement.

In one exemplary embodiment, the blocking contact piece extends along an axis, and the drive and the auxiliary drive can be such that, in a second phase during the movement in the same direction of the arcing contact pieces, a distance d, which is measured along the axis, between the throat and the blocking contact piece can be selected such that the flow rate of the quenching gas flow is at a maximum in a region which is arranged, relative to the axis, radially and laterally next to the second arcing contact piece and/or within the second arcing contact piece. The region may be continuous or comprise a plurality of subregions.

The distance d is advantageously selected such that, in the case of a quenching gas flow through the throat to the blocking contact piece (i.e. if the throat is released by the blocking contact piece), the region having the maximum flow rate is laterally (i.e. radially) next to the blocking contact piece and/or is arranged within the blocking contact piece, and, in particular, not between the two arcing contact pieces, i.e. is not arranged on the path between the two arcing contact pieces and is also not arranged radially adjacent to this path.

By maintaining such distances d, a particularly advantageous quenching gas flow can be achieved close to the blocking contact piece and therefore particularly effective arc blowing can be achieved. In particular, a high dielectric strength of the switching path can be achieved, with the result that restriking can be prevented. If, in the case of a movement in the same direction of the contact pieces 1, 2, a speed ratio v1/v2 close to one is realized, the mentioned distance d may particularly effectively be within the mentioned ranges for a longer period of time (advantageously at least 20 ms, at least 30 ms or at least 40 ms). Advantageously, such a distance d can be maintained until the opening operation is complete.

The distance d is a spacing. The distance d can be measured between the mutually facing ends of the throat and the blocking contact piece.

In one exemplary embodiment, the throat can be essentially in the form of a cylinder having an axis and a diameter D, and the drive and the auxiliary drive can be such that, in a second phase during the movement in the same direction of the arcing contact pieces, $$d=D\times((1+b'\cdot\cos\alpha)^{1/2}-1)/(2\cdot\sin\alpha\cdot\cos\alpha)$$

applies for a distance d, which is measured along the axis, between the cylinder and the blocking contact piece. The angle $\alpha$ is equal to an opening angle $\alpha$ of an extended region adjoining the throat, and the following applies for the parameter b':b'=b−F/F', wherein F' is the area of the cross-sectional area, which is arranged radially with respect to the axis, of an opening, which may be provided in the blocking contact piece, for quenching gas to flow away, and wherein the following applies for the parameter b:

$1.4 \leqq b \leqq 4.5$, in particular $1.7 \leqq b \leqq 4.0$, in particular $2.1 \leqq b \leqq 3.5$, and particularly advantageously $2.2 \leqq b \leqq 3.2$.

The throat can be essentially cylindrical, and the blocking contact piece can advantageously be likewise essentially cylindrical. The diameter of the respective cylinder (of the throat or of the blocking contact piece) need not be completely constant and can vary slightly. Deviations from a circular cross section to, for example, elliptical cross sections can be possible. The throat (or else the blocking contact piece) may have another shape, advantageously an essentially prismatic shape, and is nevertheless referred to as essentially cylindrical. A corresponding radial dimension of the throat can then be taken as the diameter D. In particular, with a high degree of accuracy it is possible to take the diameter of a circle which has the same area as the throat close to the blocking contact piece. The diameter of the cylinder or the radial dimension of the prism also need not be precisely constant. The variable relevant for determining d is the radial dimension at that end of the cylinder or prism which faces the blocking contact piece. Such shapes can also be included in the term "essentially cylindrical".

Owing to the described selection, which is dependent on the cylinder diameter, of the distance d, the flow rate condition can be met for customary breaker geometries. If the parameter b can be kept within a narrower range of the ranges specified for b, it can be ensured more easily that the advantageous quenching gas flow is maintained.

An exemplary method for opening a heavy-duty circuit breaker having a first moveable arcing contact piece and having a second moveable arcing contact piece, the two arcing contact pieces being moved in opposite directions to one another and being separated from one another, and a throat of an insulating nozzle being blocked at least partially by one of the two arcing contact pieces, which is referred to as the blocking contact piece, and the movement direction of the second arcing contact piece being reversed, is characterized in that the movement direction of the second arcing contact piece is reversed if the throat is no longer at least partially blocked by the blocking contact piece. This results in the abovementioned advantages.

The exemplary embodiment of the method can also be referred to as a method for switching an electrical current by means of a heavy-duty circuit breaker.

Advantageously, the two arcing contact pieces can be arranged coaxially relative to one another. The channel can advantageously be in the form of an annular channel.

Advantageously, one of the two arcing contact pieces, in particular the first arcing contact piece, may have an opening for accommodating the other arcing contact piece, which can be in the form of a pin, in the closed breaker state and for quenching gas to flow away in the open breaker state. In particular, this arcing contact piece may be in the form of a tulip contact having a large number of contact fingers.

Heavy-duty circuit breakers within the meaning of this application can be those breakers which are designed for rated voltages of at least approximately 72 kV. The heavy-duty circuit breaker may have one or more switching chambers.

Further exemplary embodiments and advantages are apparent from the dependent patent claims and the figures.

BRIEF DESCRIPTION OF THE DRAWINGS

The subject matter of the invention will be explained in more detail below with reference to various exemplary embodiments, which are illustrated in the attached drawings, in which, schematically.

DETAILED DESCRIPTION

Figure 1:
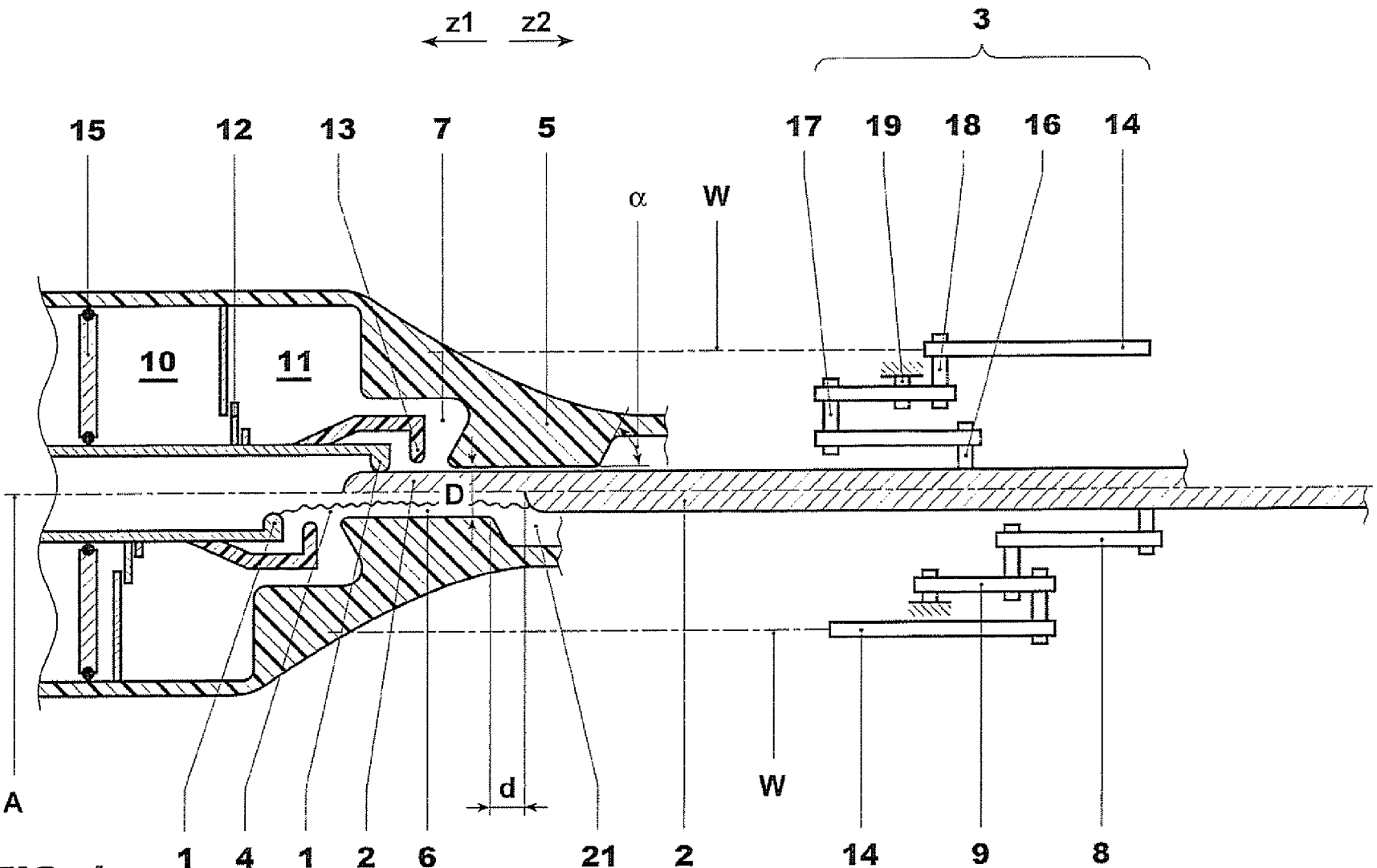
FIG. 1 shows an exemplary embodiment of a heavy-duty circuit breaker in the open state and in the closed state, in section, with a plan view of the gear.

The reference symbols used in the drawings and their significance are listed by way of summary in the list of reference symbols. In principle, identical or functionally identical parts in the figures are provided with same reference symbols. The exemplary embodiments described are examples of the disclosure and are not meant to be restrictive.

FIG. 1 shows schematically an exemplary embodiment of a heavy-duty circuit breaker in the open state (lower half of figure) and in the closed state (upper half of figure). In the right-hand part of the figure, a plan view of a gear 3 is illustrated schematically. The heavy-duty circuit breaker filled with a quenching gas (for example $SF_6$ or a mixture of $N_2$ and $SF_6$) has a first moveable arcing contact piece 1, which can be driven by a drive (not illustrated). A suitable drive may be, for example, an electrodynamic drive or a stored-energy spring mechanism.

A second arcing contact piece 2 can be driven by an auxiliary drive 3, which is realized by the gear 3 driven by the drive. In the closed state of the breaker, the two arcing contact pieces 1, 2 touch one another. In addition, rated current contact pieces (not illustrated) may also be provided.

The first contact piece 1 is rigidly connected to an insulating nozzle 5 and to an auxiliary nozzle 13. The insulating nozzle 5 has a throat 6, which can be essentially cylindrical having a diameter D. A region 21, which has an extended diameter and has an opening angle $\alpha$, adjoins the throat 6. The throat is connected to a heating chamber 11 by an annular channel 7. A compression chamber 10 is connected to the heating chamber by a valve 12. The volume of the heating chamber can be changed by means of a piston 15, which can be fixed.

The exemplary embodiment of a heavy-duty circuit breaker can be essentially rotationally symmetrical with respect to an axis A, as a result of which axial directions z1 and z2, along which the arcing contact pieces move, and radial directions, at right angles thereto, are defined.

Figure 2:
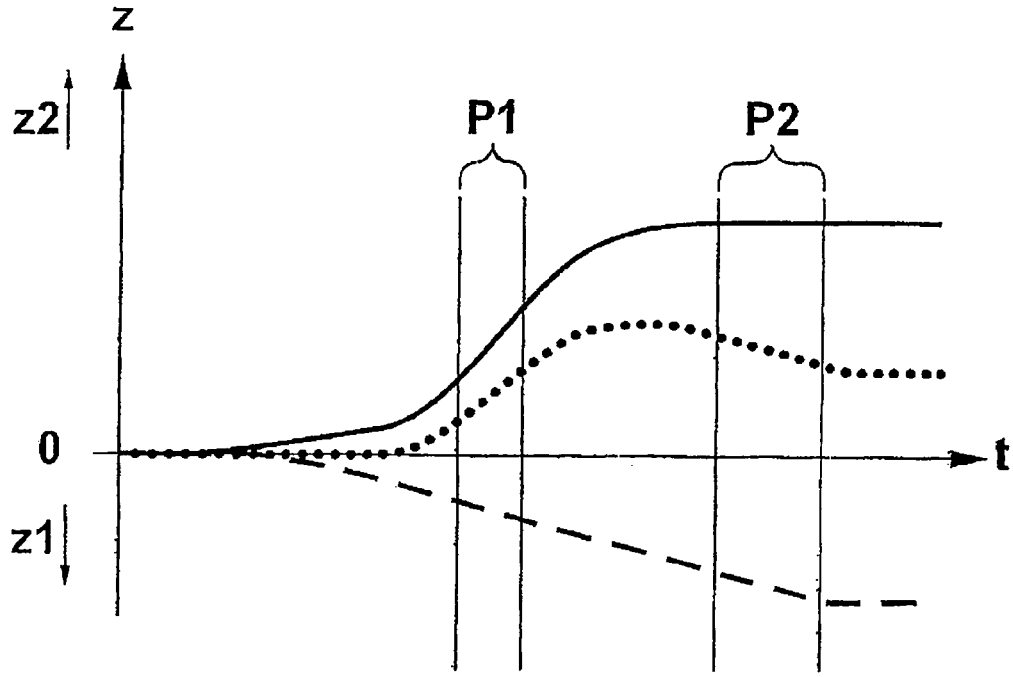
FIG. 2 shows a distance/time curve for an opening operation.

FIG. 2 illustrates schematically a distance/time graph (z/t curves) for the movement of the first contact piece 1 (dashed curve) and the second contact piece 2 (dotted curve) and for the relative movement of the two contact pieces (continuous line).

Figure 3:
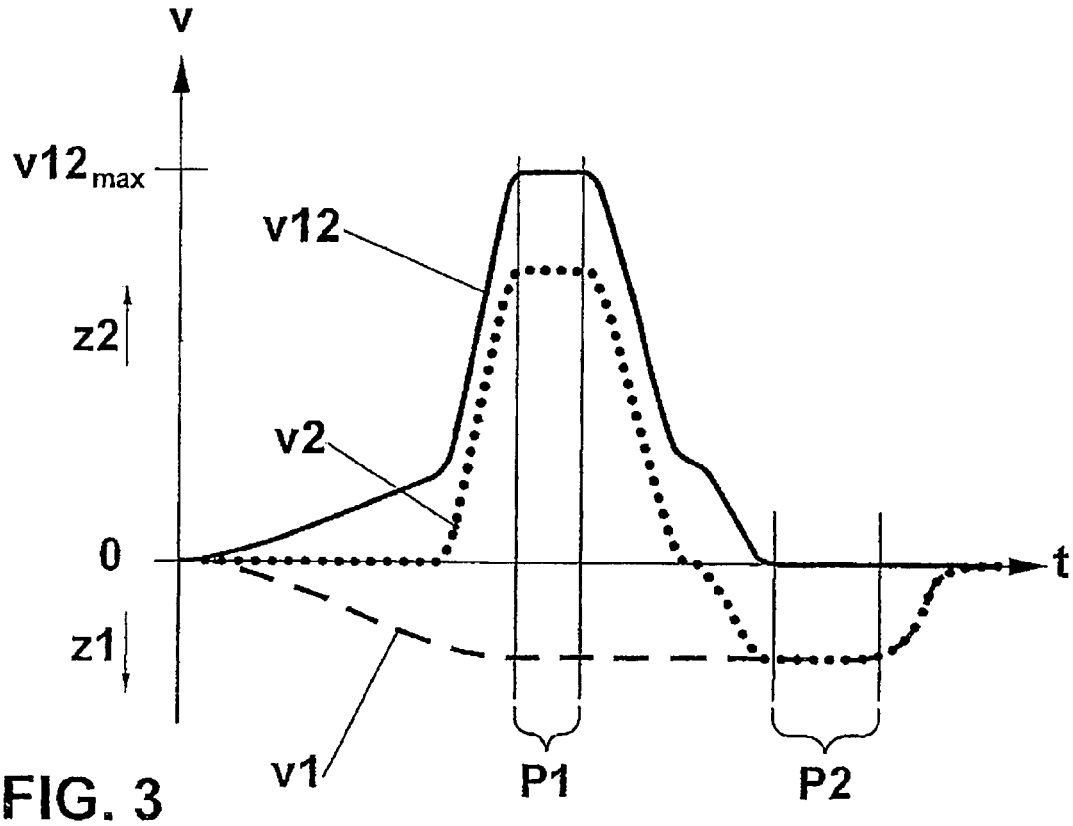
FIG. 3 shows a speed/time curve for an opening operation.

The corresponding speed/time curves (v/t curves) are illustrated schematically in FIG. 3. The speed v1 of the first contact piece 1 (dashed curve) and the speed v2 of the second contact piece 2 (dotted curve) and the relative speed v12 of the two contact pieces (continuous line) are illustrated.

During an opening operation for interrupting a current flowing through the heavy-duty circuit breaker, initially the first arcing contact piece 1 and the insulating nozzle 5, the auxiliary nozzle 13 and the valve 12 move in the direction z1. With an optional delay, the second contact piece 2 moves in the direction z2. The mass to be moved directly by the drive is greater than the mass to be moved by the gear 3. The acceleration of the second contact piece can therefore be paused until shortly before the maximum speed v1 is reached. Once it has reached its maximum speed, the first contact piece 1 remains essentially at this speed until a braking operation at the end of the opening operation.

Owing to the fixed piston 15, the volume of the compression chamber is reduced, and the valve 12 allows quenching gas to flow into the heating chamber 11. Then, during a phase of high or maximum relative speed v12, the contact separation takes place, with an arc 4 being struck. It is possible that the contact separation occurs shortly (a few milliseconds) before or after the maximum relative speeds have been reached.

The arc 4 results in heating of the quenching gas and detaches wear material in the throat 6 from the insulating nozzle 5. By means of the annular channel 7, an excess pressure can thus be produced in the heating chamber 11. Above a pressure difference between the heating chamber 11 and the compression chamber 10 which can be predetermined by the valve 12, for example if a greater pressure prevails in the heating chamber 11 than in the compression chamber 10, the valve 12 closes. The quenching gas, which later flows out of the heating chamber 11 and possibly also out of the compression chamber 10 through the heating chamber 11 then through the channel 7 into the quenching path arranged between the two contact pieces 1, 2, can then be used for quenching the arc 4.

Once that end of the second arcing contact piece 2 which faces the first arcing contact piece 1 has traversed the majority of the length of the throat 6 at the maximum speed v2, v2 is reduced again. The second contact piece 2 comes to a standstill and, once it has released or unblocked the throat 6, moves in the direction z1 and therefore parallel to (in the same direction as) the first contact piece 1. After this movement direction reversal, the second contact piece 2 soon reaches the same speed-as the first contact piece 1.

As soon as the throat 6 is no longer at least partially blocked by the second contact piece 2, quenching gas can flow away through the channel 7 not only through the tulip-shaped first contact piece 1 (in the direction z1), but also through the throat 6 and past the pin-shaped second contact piece 2 (in the direction z2).

Owing to the speed ratio v1/v2 of essentially 1:1 in the case of a concurrent movement in the same direction of the two contact pieces 1, 2, a distance d between the second contact piece 2, which can be in the form of a pin, and the throat 6 can be kept essentially constant. This distance d is selected such that, in the event of a quenching gas flow through the throat 6 to the blocking contact piece 2 (in the direction z2), the maximum flow rate is laterally (i.e. radially) next to the blocking contact piece 2, and in particular not on the path between the two arcing contact pieces 1 and 2 (or radially adjacent to this path). As a result, particularly efficient arc blowing can be achieved, and restriking of the arc can be effectively suppressed. The distance d is selected as $d \approx (0.7 \pm 0.2) \times D$, wherein D is the diameter of the throat 6 (at its z2 end). If the angle $\alpha$ were less than 45°, the distance d would advantageously be selected approximately as $d \approx (0.7 \pm 0.2) \times D/\tan \alpha$.

If, owing to the gear 3, a speed ratio v1/v2 of 1:1 (after the movement direction reversal) is predetermined, the distance d and therefore also the corresponding flow conditions can be maintained even when the breaker enters the damping state, i.e. the contact pieces 1, 2 can be braked by a damping mechanism. Towards the end of an opening operation, a return movement of the first contact piece 1 brought about by the pressure conditions in the heating chamber 11 and/or the compression chamber 10 also often results. Owing to such a return movement, it is also not possible for the distance d to be changed when selecting a speed ratio v1/v2 of 1:1. In this regard, optimum flow conditions can be maintained up to the end of the opening movement and, as a result, reliable arc quenching can be ensured without restriking. Owing to the speed ratio v1/v2 of 1:1, the distance between the two contact pieces 1 and 2 is also constant, such that the electrical field distribution can be kept constant.

Owing to a speed ratio v1/v2 of approximately 1:1 after the movement direction reversal, it is possible to reduce the load of the damping device or to use a less complex damping device, since a longer damping excursion (longer path over which the movements are braked) can be provided. Since, once a sufficient (typically virtually maximum) distance between the arcing contact pieces has been reached early, the braking of the contact pieces can already begin since the distance between the contact pieces is kept constant by the 1:1 ratio. For a speed ratio v1/v2 which is close to one, the same in principle applies, but small changes in the distance between the contact pieces arise.

FIGS. 2 and 3 show the movements of the contact pieces 1, 2 only up to shortly after the onset of the damping. P1 denotes a first phase, during which, in the case of a movement in opposite directions of the two contact pieces 1, 2, a maximum relative speed v12 is present. In the case illustrated this is v12≈20 m/s. P2 denotes a second phase, during which, in the case of a movement in the same direction of the two contact pieces 1, 2, a speed ratio v1/v2 of approximately 1:1 is present once the throat has been released or unblocked. In FIGS. 2 and 3, the end of the second phase P2 coincides with the onset of the damping.

FIGS. 4 to 7 show schematically in a side view at different points in time a detail of an exemplary embodiment of a heavy-duty circuit breaker having a gear 3. As can also be seen in the right-hand part of FIG. 1 (in plan view there), a lever 8 is mounted at a first end by means of a bolt 16 in rotatable fashion on the second contact piece 2. The lever 8 is mounted in rotatable fashion on a limb of an angled lever 9 by means of a bolt 17 at the second end of the lever 8. The second limb of the angled lever 9 is guided in a slotted-link disk 14 by means of a bolt 18. The angled lever 9 is mounted in rotatable fashion by means of a bolt 19, which is fixed in position and which is fixed, for example, to the housing of the heavy-duty circuit breaker. As symbolized by means of a line of action W, the movement of the slotted-link disk 14 is coupled (e.g., rigidly) to the movement of the first contact piece 1.

The movement of the second contact piece 2 is therefore controlled via a lever mechanism by means of the slotted-link disk 14, which is connected to the drive. The gear 3 can convert a linear movement (of the drive) at a constant speed into a movement with movement direction reversal. A desired speed profile for the second contact piece 2 can be selected by suitably selecting the lever lengths and angles.

As illustrated in FIG. 1, the gear 3 may be symmetrical, which results in a more favorable force distribution and increased stability.

Figure 4:
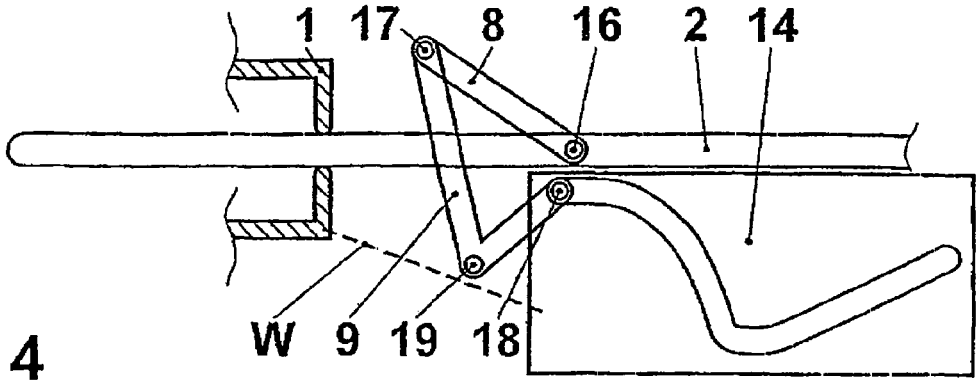
FIG. 4 shows a detail of an exemplary embodiment of a heavy-duty circuit breaker having a gear, in a side view, in the closed state.
Figure 5:
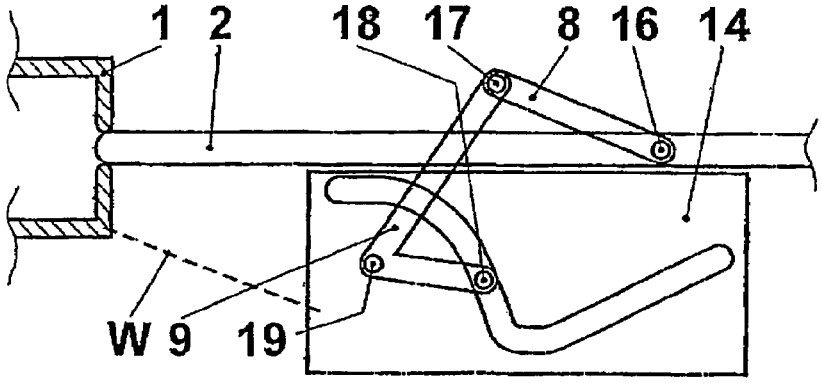
FIG. 5 shows a detail of an exemplary embodiment of a heavy-duty circuit breaker, in a side view, at the time of contact separation.
Figure 6:
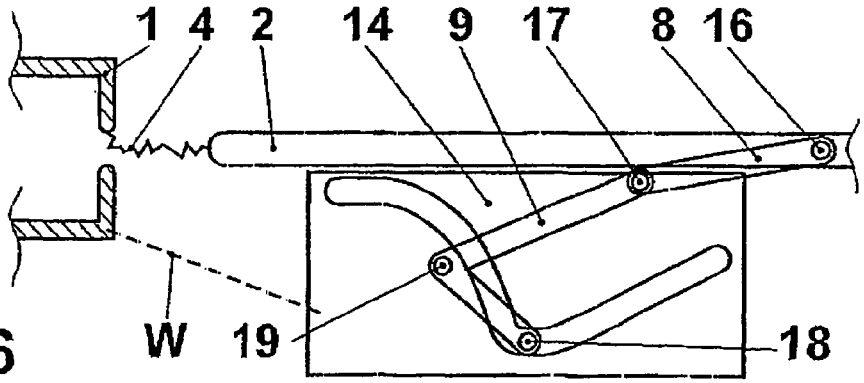
FIG. 6 shows a detail of an exemplary embodiment of a heavy-duty circuit breaker having a gear, in a side view, during the movement reversal.
Figure 7:
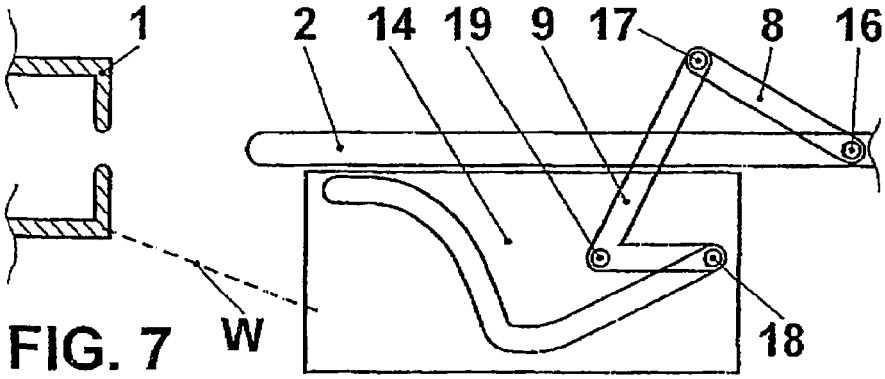
FIG. 7 shows a detail of an exemplary embodiment of a heavy-duty circuit breaker having a gear, in a side view, in the open state.

FIG. 4 shows the closed state of the breaker at the beginning of an opening movement. FIG. 5 shows the state approximately at the time of the contact separation. FIG. 6 shows a state during the movement direction reversal of the second contact piece 2. FIG. 7 shows the open state of the breaker at the end of an opening movement.

The load of a damping device, which brakes the movement of the contact pieces, can be reduced by reducing the speed v2 of the second contact piece 2 at the end of the opening movement, as less kinetic energy must be absorbed.

The speed v1 of the first contact piece 1 after the initial acceleration may typically be between 3 m/s and 10 m/s, for example 5 m/s. The speed v2 of the second contact piece 2 may typically have a maximum of 10 m/s to 20 m/s, for example 15 m/s. The maximum speed ratio v1/v2 (in the case of a movement in opposite directions) may be between 1:2.4 and 1:3.5, for example 1:3. As a result, correspondingly high relative speeds v12 of between typically 15 m/s, 20 m/s and more can be reached which allow rapid release of the throat 6 and efficient arc blowing possible by provision of a high quenching gas pressure within a short time period. A large distance between the contact pieces 1 and 2 (insulating path) can be achieved within a very short time period. A corresponding heavy-duty circuit breaker may be designed for rated short-circuit currents of over 40 kA or over 50 kA at rated voltages of over 170 kV or over 200 kV.

The maximum relative speed $v_{12,max}$ of the contact pieces 1, 2 for such a breaker may advantageously be selected to be at least 40%, in particular at least 60% and even at least 80% greater than that which would be required for capacitive switching. Advantageously, the switching chamber can be such that, if it is installed in a single-chamber heavy-duty circuit breaker, the following applies for the maximum relative speed $v_{12,max}$ of the two arcing contact pieces (1, 2) relative to one another during an opening operation: $V_{12,max} \geqq k' \times U_N \cdot p \cdot f/(E_{crit} \cdot P_0)$, wherein $U_N$ is the rated voltage of the heavy-duty circuit breaker, p is the pole factor of the heavy-duty circuit breaker, $E_{crit}$ is the threshold field strength for discharges of the quenching gas, and $p_0$ is the filling pressure of the quenching gas, and f is the high-voltage system frequency, for which the heavy-duty circuit breaker is designed. The factor k' can have a range of values, e.g., 23, 27 or 31. In the case of a heavy-duty circuit breaker having more than one switching chamber, a further factor must additionally be multiplied, which takes into account the voltage shift in the heavy-duty circuit breaker.

This allows to produce an arc having a very large extent within a very short time period. A large surface, in particular the entire inner surface of the throat, can be used over a relatively long time period for producing (vaporizing) arc-quenching material. As a result, a large quantity of arc-quenching material is produced, so that efficient arc blowing is achieved. Owing to the very fast relative movement, this large quantity of arc-quenching material can be produced even within a very short time period, so that a very high quenching gas pressure can be produced and the pressure can be produced very quickly after the contact separation. As a result, very powerful arc blowing and therefore very reliable switching, even of high short-circuit currents, can be achieved.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and- equivalence thereof are intended to be embraced therein.

LIST OF REFERENCE SYMBOLS

1 First arcing contact piece
2 Second arcing contact piece, blocking contact piece
3 Auxiliary drive, gear
4 Arc
5 Insulating nozzle
6 Throat
7 Channel, annular channel
8 Lever
9 Angled lever
10 Compression chamber
11 Heating chamber
12 Valve
13 Auxiliary nozzle
14 Slotted link, slotted-link disk
15 Piston
16, 17, 18 Bolts, rotational mounting
19 Fixed bolt, rotational mounting
21 Region, extended (in diameter) region
A Axis, axis of symmetry
b,b' Parameter
d Distance
D Diameter, radial dimension
P1 First phase
P2 Second phase
v1 Speed of the first contact piece
v2 Speed of the second contact piece
v12 Relative speed of the contact pieces
$v_{12,max}$ Maximum relative speed of the contact pieces
w Line of action
z Distance coordinate
z1 Direction
z2 Direction
α' Angle
α Opening angle

The invention claimed is:

1. A heavy-duty circuit breaker, which can be filled with a quenching gas, having a first moveable arcing contact piece and a second moveable arcing contact piece, having an auxiliary drive for driving the second arcing contact piece, having an arc which may burn between the arcing contact pieces, having a heating chamber for temporarily storing quenching gas heated by the arc, and having an insulating nozzle, which has a throat for guiding a quenching gas flow, which throat is connected to the heating chamber by means of a channel and can be blocked by one of the two arcing contact pieces, which is referred to as the blocking contact piece, the auxiliary drive being designed such that, during an opening operation, a movement direction reversal of the second arcing contact piece from a movement in opposite directions to a movement in the same direction of the two arcing contact pieces takes place, wherein the auxiliary drive is designed such that, during an opening operation, the movement direction reversal of the second arcing contact piece takes place if the throat is no longer blocked by the blocking contact piece.

2. The heavy-duty circuit breaker as claimed in claim 1, wherein the auxiliary drive comprises an electrodynamic drive.

3. The heavy-duty circuit breaker as claimed in claim 1, wherein the auxiliary drive is a gear which can be driven by movement of the first arcing contact piece.

4. The heavy-duty circuit breaker as claimed in claim 3, wherein the gear comprises at least one slotted-link disk.

5. The heavy-duty circuit breaker as claimed in claim 3, wherein the gear contains at least one lever and in addition at least one angled lever.

6. The heavy-duty circuit breaker as claimed in claim 3, wherein the gear has at least two levers, whose ends have slots, which come into engagement, one after the other, with a transmission rod in the case of an opening operation.

7. The heavy-duty circuit breaker as claimed in claim 1, wherein the second arcing contact piece is the blocking contact piece.

8. The heavy-duty circuit breaker as claimed in claim 1, comprising an auxiliary nozzle arranged adjacent to the first arcing contact piece and forming, together with the insulating nozzle, the channel.

9. The heavy-duty circuit breaker as claimed in claim 1, wherein the throat is cylindrical, and in that the blocking contact piece is cylindrical.

10. The heavy-duty circuit breaker as claimed in claim 1, comprising a compression chamber, the volume of which is reduced during an opening operation.

11. The heavy-duty circuit breaker as claimed in claim 10, wherein the compression chamber is different from the heating chamber, and in that a valve is provided between the compression chamber and the heating chamber.

12. The heavy-duty circuit breaker as claimed in claim 1, wherein the auxiliary drive is designed such that, in a first phase (P1) during the movement in opposite directions of the arcing contact pieces, a ratio $v1/v2$ of the speed $v1$ of the first arcing contact piece to the speed $v2$ of the second arcing contact piece of $v1/v2 \leqq 1:2.4$ is achieved.

13. The heavy-duty circuit breaker as claimed in claim 1, wherein the auxiliary drive is designed such that, in a first phase (P1) during the movement in opposite directions of the arcing contact pieces, a relative speed $v12$ of the two arcing contact pieces of $v12 \geqq 15$ m/s is reached.

14. The heavy-duty circuit breaker as claimed in claim 1 wherein the auxiliary drive is designed such that, in a second phase (P2) during the movement in the same direction of the arcing contact pieces, the following applies for the ratio $v1/v2$ of the speed $v1$ of the first arcing contact piece to the speed $v2$ of the second arcing contact piece:

$$0.4 \leqq v1/v2 \leqq 1.2.$$

15. The heavy-duty circuit breaker as claimed in claim 1, wherein the blocking contact piece extends along an axis (A), and in that the auxiliary drive is designed such that, in a second phase (P2) during the movement in the same direction of the arcing contact pieces, a distance d, which is measured along the axis (A), between the throat and the blocking contact piece is selected such that the flow rate of the quenching gas flow is at a maximum in a region which is arranged, with respect to the axis (A), radially and laterally next to the second arcing contact piece and/or within the second arcing contact piece.

16. A method for opening a heavy-duty circuit breaker having a first moveable arcing contact piece and having a second moveable arcing contact piece, the two arcing contact pieces being moved in opposite directions relative to one another and being separated from one another, and a throat of an insulating nozzle being at least partially blocked by one of the two arcing contact pieces, which is referred to as the blocking contact piece, and the movement direction of the second arcing contact piece being reversed, wherein the movement direction of the second arcing contact piece is reversed, if the throat is no longer at least partially blocked by the blocking contact piece, wherein, after the movement in opposite directions, a movement in the same direction of the two arcing contact pieces takes place.

17. The heavy-duty circuit breaker as claimed in claim 4, wherein the gear contains at least one lever and in addition at least one angled lever.

18. The heavy-duty circuit breaker as claimed in claim 3, wherein the second arcing contact piece is the blocking contact piece.

19. The heavy-duty circuit breaker as claimed in claim 3, wherein the throat is cylindrical, and in that the blocking contact piece is cylindrical.

20. The heavy-duty circuit breaker as claimed in claim 1, wherein the auxiliary drive is designed such that, in a first phase (P1) during the movement in opposite directions of the arcing contact pieces, a ratio $v1/v2$ of the speed $v1$ of the first arcing contact piece to the speed $v2$ of the second arcing contact piece of $v1/v2 \leqq 1:2.8$ is achieved.

21. The heavy-duty circuit breaker as claimed in claim 1, wherein the auxiliary drive is designed such that, in a first phase (P1) during the movement in opposite directions of the arcing contact pieces, a relative speed $v12$ of the two arcing contact pieces of $v12 \leqq 18$ m/s is reached.

22. The heavy-duty circuit breaker as claimed in claim 1, wherein the auxiliary drive is designed such that, in a second phase (P2) during the movement in the same direction of the arcing contact pieces, the following applies for the ratio $v1/v2$ of the speed $v1$ of the first arcing contact piece to the speed $v2$ of the second arcing contact piece: $0.75 \leqq v1/v2 \leqq 1.15$.

23. The heavy-duty circuit breaker as claimed in claim 7, wherein the blocking contact piece extends along an axis (A), and in that the auxiliary drive is designed such that, in a second phase (P2) during the movement in the same direction of the arcing contact pieces, a distance d, which is measured along the axis (A), between the throat and the blocking contact piece is selected such that the flow rate of the quenching gas flow is at a maximum in a region which is arranged, with respect to the axis (A), radially and laterally next to the second arcing contact piece and/or within the second arcing contact piece.

* * * * *